US012435939B1

(12) United States Patent
Sugg

(10) Patent No.: US 12,435,939 B1
(45) Date of Patent: Oct. 7, 2025

(54) BARREL SHOT TRACKER, FIREARM WITH BARREL SHOT TRACKER AND METHODS OF USE THEREOF

(71) Applicant: Edward Sugg, South Riding, VA (US)

(72) Inventor: Edward Sugg, South Riding, VA (US)

( * ) Notice: Subject to any disclaimer, the term of this patent is extended or adjusted under 35 U.S.C. 154(b) by 43 days.

(21) Appl. No.: 18/322,313

(22) Filed: May 23, 2023

Related U.S. Application Data

(60) Provisional application No. 63/344,875, filed on May 23, 2022.

(51) Int. Cl.

| | |
|---|---|
| ***F41A 31/02*** | (2006.01) |
| ***F41A 19/01*** | (2006.01) |
| ***F41A 21/32*** | (2006.01) |
| ***F41A 21/48*** | (2006.01) |

(52) U.S. Cl.
CPC ..... *F41A 19/01* (2013.01); *F41A 21/325* (2013.01); *F41A 21/48* (2013.01); *F41A 31/02* (2013.01)

(58) Field of Classification Search
CPC ..... F41A 31/02
See application file for complete search history.

(56) References Cited

U.S. PATENT DOCUMENTS

| | | | | |
|---|---|---|---|---|
| 7,143,644 | B2 | 12/2006 | Johnson et al. | |
| 8,109,023 | B2 | 2/2012 | Pikielny | |
| 8,826,575 | B2 | 9/2014 | Ufer et al. | |
| 2005/0114084 | A1* | 5/2005 | Johnson | F41A 19/01 702/183 |

* cited by examiner

*Primary Examiner* — J. Woodrow Eldred
(74) *Attorney, Agent, or Firm* — ArentFox Schiff LLP

(57) ABSTRACT

An automatic firearm, a barrel usable with an automatic firearm and a shot counter for mounting to a barrel of an automatic firearm. The shot counter is configured to track the number of shots fired through the barrel and to provide an indication of the remaining lifespan of the barrel.

20 Claims, 7 Drawing Sheets

BARREL SHOT TRACKER, FIREARM WITH BARREL SHOT TRACKER AND METHODS OF USE THEREOF

CROSS REFERENCE TO RELATED APPLICATIONS

This application claims priority to U.S. Provisional Application No. 63/344,875, filed on May 23, 2022, titled: "Carry Handle Sensor," the entirety of which is expressly incorporated herein by reference.

BACKGROUND

The squad automatic weapon ("SAW"), and derivatives and variants has been in production for about 44 years (first offered around 1976) and has been used by the US Military ("DOD") since about 1984. During that time, it has undergone improvements including a US DOD Product Improvement Program. It has also been produced by about a dozen countries in both Licensed and Unlicensed production. It is the dominant "light" machinegun ("LMG") in the Western World and is in service with several dozen countries. Though machine guns are cited, this disclosure also has applicable to barrels with severe use such as rapid-fire cannons (typically 20 mm-76 mm in bore diameter). The disclosure is further relevant to other weapons such as mortars, artillery tubes, naval guns, and main battle tank guns.

SUMMARY

The following aspects and aspects thereof are described and illustrated in conjunction with systems, tools and methods which are meant to be exemplary and illustrative, not limiting in scope.

In some aspects, the techniques described herein relate to an automatic firearm including: a barrel that is removeably mounted to the firearm, wherein the barrel further includes a handle mounted thereon, the barrel further includes: a shot counter, wherein the shot counter is configured to track the number of shots fired through the barrel, wherein the shot counter is configured to provide an indication of the remaining lifespan of the barrel.

In some aspects, the techniques described herein relate to a barrel usable with an automatic firearm including: a shot counter mounted to but spaced from the outer surface of the barrel, wherein the shot counter is configured to track the number of shots fired through the barrel, wherein the shot counter is configured to provide an indication of the remaining lifespan of the barrel.

In some aspects, the techniques described herein relate to a shot counter configured to be mounted to a barrel of an automatic firearm, the shot counter including: a microcontroller with a non-volatile memory for analyzing and storing sensor data; and an accelerometer for detecting shots fired through the barrel, wherein the shot counter is configured to track the number of shots fired through the barrel, wherein the shot counter is configured to provide an indication of the remaining lifespan of the barrel.

aspects and aspects will become apparent by reference to the drawings and by study of the following detailed description.

BRIEF DESCRIPTION OF THE DRAWINGS

Example aspects are illustrated in the drawings. It is intended that the aspects and figures disclosed herein are to be considered illustrative rather than restrictive.

DETAILED DESCRIPTION

Figure 1:
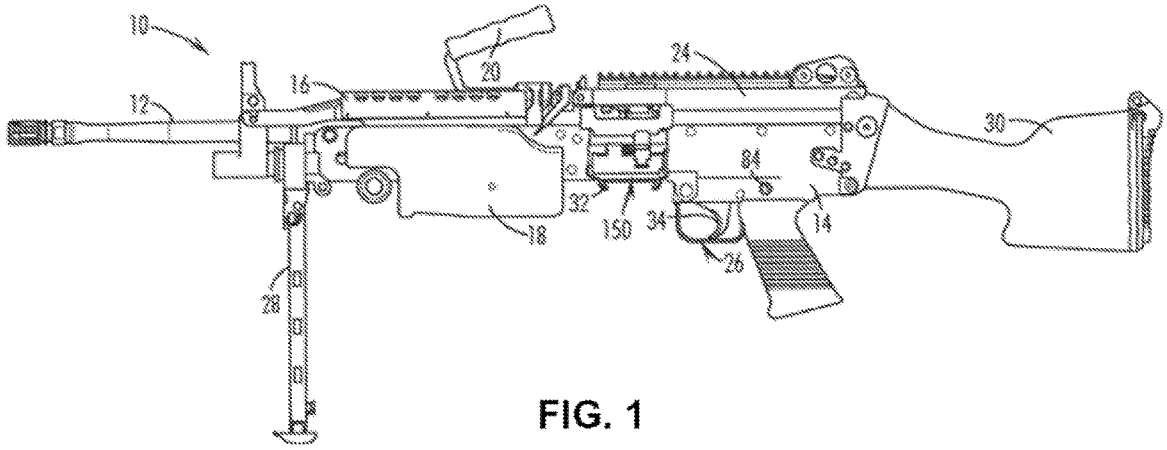
FIG. 1 Related Art
FIG. 1 is a left side view of one example of a firearm usable with aspects disclosed herein.

In the following detailed description, reference is made to the accompanying figures, which form a part thereof. In the figures, similar symbols typically identify similar components, unless context dictates otherwise. The illustrative aspects described in the detailed description, figures, and claims are not meant to be limiting. Other aspects may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein

I. Terminology

The following includes definitions of selected terms employed herein. The definitions include various examples and/or forms of components that fall within the scope of a term and that may be used for implementation. The examples are not intended to be limiting. Further, it will be obvious to one skilled in the art that the present disclosure may be practiced without these specific details. In other instances, well-known methods, procedures, and components have not been described in detail so as to not unnecessarily obscure aspects of the present disclosure.

Throughout the disclosure, the term substantially or approximately may be used as a modifier for a geometric relationship between elements or for the shape of an element or component. While the terms substantially or approximately are not limited to a specific variation and may cover any variation that is understood by one of ordinary skill in the art to be an acceptable variation, some examples are provided as follows. In one example, the terms substantially or approximately may include a variation of less than 10% of the dimension of the object or component. In another example, the terms substantially or approximately may include a variation of less than 5% of the object or component. If the terms substantially or approximately are used to define the angular relationship of one element to another element, one non-limiting example of the terms may include a variation of 5 degrees or less. These examples are not intended to be limiting and may be increased or decreased based on the understanding of acceptable limits to one of ordinary skill in the art.

For purposes of the disclosure, directional terms are expressed generally with relation to a standard frame of reference when the firearm is in an in-use read-to-fire orientation.

II. Overview

Machine guns are firearms designed to fire a high volume stream of fired ammunition, potentially for an extended period. They have various applications, including military operations, law enforcement, and sometimes for recreational use. Some machine guns feature a single interchangeable barrel that must endure the stresses and heat generated during firing. For example, barrels of machine guns have been observed to reach temperatures between 500 degrees Fahrenheit (° F.) to 1650° F. High temperatures typically result in wear and softening of the barrel and barrel components. For example, the lands, which impart spin on a projectile are especially susceptible to softening and premature wear when a machine gun is fired at a high throughput. Once deformation of the lands occurs, projectile accuracy may be reduced. Projectile accuracy may be critical in certain situations, thus barrels are frequently exchanged or replaced when it is suspected that the operating conditions have either overheated and/or have deformed or otherwise worn-out the barrel. It has been observed that barrel-life typically is affected by the number of rounds fired therethrough and/or the rate of fire or throughput of the machine gun. For example, barrels have been observed to experience wear and/or deformation that affects performance with as little as 1500 rounds of throughput to over 20,000 rounds. The cost of barrel is significant, thus more accurate prediction of a barrel's end of life can reduce costs and improve efficiency of managing consumable barrels. Further, aspects described herein may reduce waste (i.e., by preventing barrels that are not yet worn-out from being replaced prematurely). Additionally, aspects described herein reduce the risk of catastrophic or otherwise dangerous failures which may occur due to continuous use of a barrel that has been overused or has otherwise worn-out.

One aspect of the disclosure is related to the implementation of a monitoring device for tracking the number of shots fired on a specific barrel. By tracking the number of shots fired through a specific barrel, gun operators and armorers or maintenance staff can determine the optimal time for barrel replacement or maintenance and/or can accurately track use of a specific barrel. While shot counters have been implemented into firearms in the past, this disclosure is related to tracking metrics that are related to barrel life.

The current disclosure provides examples of a barrel having an integrated shot counting system, a firearm implementing the aforementioned barrel, and methods of use thereof. The shot counting system may implement sensor(s) and a system for processing sensor outputs to track or otherwise determine at least one of the number of shots fired through the barrel associated therewith and/or a time elapsed between shots.

The disclosed system and apparatus may utilize one or more sensors associated with or otherwise mounted to the barrel to detect and record each shot fired. These sensor(s) capture relevant data, which may include any one, combination, or all of a number of shots, a time, sequence, and/or intensity of each shot. The collected data is then processed by an onboard computing module, which stores or sends the data and provides usable metrics to a user so they can check the barrel life and/or previous use of the barrel.

In preferred aspects, the barrel mounted sensor is implemented to track and monitor barrel usage and life. At present, there is no good way to ascertain the number of rounds fired through a machine gun barrel. In the US Military, the use of manufacturer recommended barrel tests (e.g., the FN or Fabrique National M240 Barrel Test—which is used for the M240 and variants as well as the MK48) has been in place for and rarely if ever does a machine gun barrel fail the test. The test calls for a 20,000 round firing life. In tests that the author has participated in, at no point did the test barrel get hotter than between 500-600F anywhere on the barrel exterior during such a test. Chrome Moly Vanadium (CMV), the material used to fabricate barrels, does not degrade significantly in hardness or strength at those temperatures-thus the "test" produces an entirely unrealistic result. In actual combat use or harsh training, barrels may last less than 1500 rounds. In a preferred aspect, the shot counter described herein measures not only rounds fired (cumulative and batch totals) but also the pace or frequency of fire as severe (long bursts or frequent bursts) since fast throughput or long periods of sequential fire have been found to degrade a barrel faster than slower paced firing. Thus, the shot counter could be used as both a management tool (to enable accurately measuring barrel life in total rounds fired and root out cases where shooters are abusing-intentionally or ignorantly-barrels in training use) as well as a diagnostic tool for accurately creating a realistic picture of actual barrel life in real world use.

In some example aspects of the disclosure, the counter is connected to the barrel and the barrel only. There are numerous ways of installing sensors on weapon receivers-typically in the firing grip of the weapon (e.g., frame of a pistol internal to the firing grip, or the pistol grip of a rifle like the M4/M16 or the "spade grip" of a M2/M3.50 cal BMG etc). While this is good and useful—and should be maintained even in a QCB MG application as knowing round counts and other data is very important—it may be treated as separate and apart from the disclosed application of a barrel mounted counter. A barrel mounted counter can be advantageous from a financial standpoint as a single machine gun barrel can cost as much as 2-4 service rifles (which typically last 10-50,000 rounds) or as much as 4-12 service pistols (which often last 10-50,000 rounds or as much in some cases as 50-100,000 rounds). While cited as having in some cases (e.g., M240 and MK48 machine guns) a "20,000 round" barrel life with testing, actual experience has shown the life to be far less—and as little as 1500 or so rounds. Machine gun barrels will typically either lose accuracy due to excessive yaw (unstable flight of the projectiles) or by loss of velocity (greater than 200 feet per second from original test velocity). The aspects described herein thus allow for an accurate method for determining the rounds fired and the severity of firing regimes and effects on the particular barrel.

Additional aspects are described in the Detailed Examples section below.

III. Detailed Examples

The current disclosure is applicable to any firearm platform. However, the aspects described herein may be especially relevant to firearms that generate between 1,000 foot pounds of energy to about 12,000 foot pounds of energy at the muzzle. Some examples of which include automatic (i.e., capable of continual fire) firearms that are capable of firing 0.50 caliber Browning Machine Gun (BMG), 5.56×45 millimeter (mm) NATO, 0.223 Remington (REM), 7.62×51 mm NATO, and/or 6.5 mm Creedmore, ammunition Many firearms that are relevant to this disclosure have quick-change barrels. One example of a firearm platform that employs such a quick-change barrel is the FABRIQUE NATIONALE D'HERSTAL ("FN") MINIMI platform, which includes many variants. Subsequent variants of the FN MINIMI include the DOD-designation M249, MK46, MK48, and the MGA SAW. It is noted that while one platform is provided as an example, one of ordinary skill in the art would understand that aspects described and claimed herein are applicable to any firearm with a removable barrel, especially platforms that include a rapid-exchange type barrel. The firearms mentioned throughout the disclosure may hereinafter be interchangeably referred to as the SAW et al. As used herein, "M249 platform" should be understood to encompass any firearm derived from the FN MINIMI design including, but not limited to, the M249 firearm. The M249 platform is an open-bolt, slam fire weapon, but some variants may be a closed-bolt, semi-automatic variant.

Figure 2:
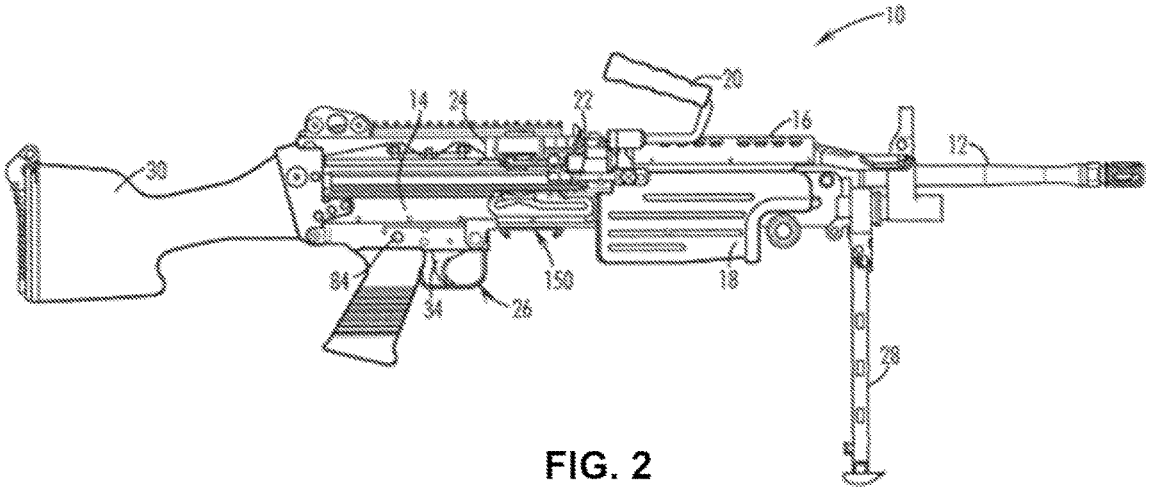
FIG. 2 Related Art
FIG. 2 is a right-side view of the example firearm of FIG. 1.

FIGS. 1 and 2 show left and right-side views, respectively that are commonly present in an FN platform firearm 10. The firearm may include a barrel 12, a receiver 14, a heat shield 16, and a hand guard 18. The firearm may further include a carrying handle 20, a charging handle 22, and a cover plate 24. Below receiver 14 is a trigger assembly 26. Attached to barrel 12 is a bipod 28. On the proximal end of rifle 10 is a buttstock 30. Additional aspects and details of a closed-bolt variant of the M249 platform are described with respect to FIGS. 3 and 4 below. Any description of a closed-bolt variant should be understood to be merely illustrative and not be understood to exclude the more common open-bolt M249 platform firearms or other platforms, for example.

Figure 3:
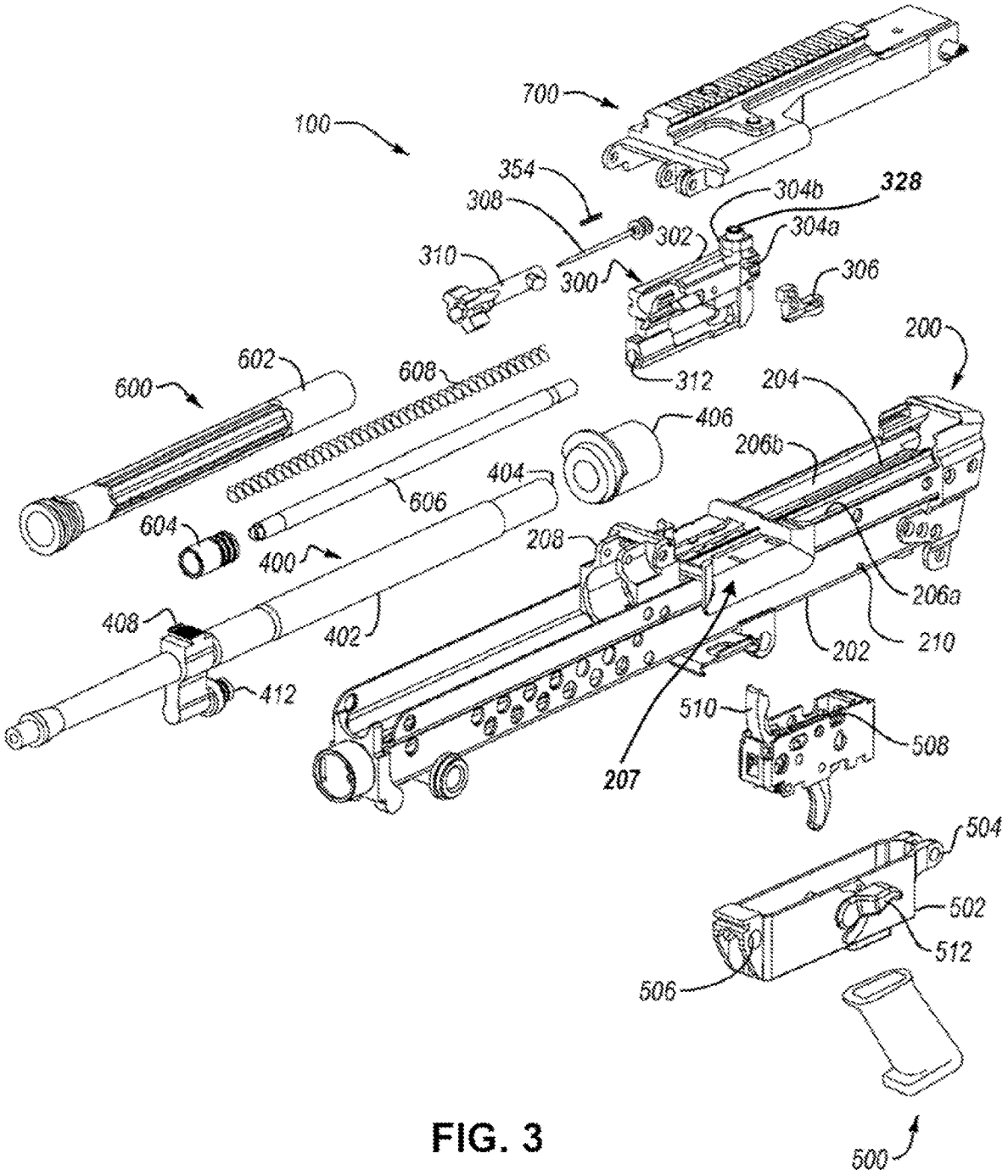
FIG. 3 Related Art
FIG. 3 is an isometric exploded view of one example of a firearm usable with aspects disclosed herein.

FIGS. 2 and 3 show isometric exploded views of the main operational components of a firearm 100 usable with aspects of the current disclosure. FIG. 3 shows a lower isometric exploded view of the main components of the firearm 100. The firearm 100 may include a receiver 200, which may carry upon it various information engraved or otherwise affixed thereto. The information on the receiver 200 may commonly include model designation and identification information unique to that receiver to identify the firearm 100 for registration and ownership purposes. The receiver 200 may also enable the connection and assembly of many of the operational components on or in the receiver 200. For example, the receiver 200 includes a receiver body 202 that defines an interior channel 204 with left and right receiver rails 206*a*, 206*b* affixed thereto. The left receiver rail 206*a* and right receiver rail 206*b* may be symmetrical with respect to one another, or they may be asymmetrical. For example, the left receiver rail 206*a* and the right receiver rail 206*b* may have differing thicknesses or they may be positioned differently in the interior channel 204. The right receiver rail 206*b* and the left receiver rail 206*a* may be interchangeably referred to as the right receiver guide and left receiver guide, respectively. The left receiver rail 206*a* may be thicker or thinner than the right receiver rail 206*b*. Additionally or alternatively, the left receiver rail 206*a* may be positioned higher or lower than the right receiver rail 206*b*. Furthermore, the left receiver rail 206*a* may be longer or shorter longitudinally within the interior channel 204 than the right receiver rail 206*b*. The receiver 200 further comprises a selector stop 210. The receiver may have attached thereto a feed tray 207. In one example, the feed tray 207 may for example be pivotally mounted to the receiver 202.

The operating group 300, which may interchangeably be referred to throughout the disclosure as the OP group may be slidably connected to the receiver 200 by the left and right receiver rails 206*a*, 206*b*. The operating group 300 having an elongate upper section in which there are left and right longitudinal recessions 304*a*, 304*b*. The left and right longitudinal recessions 304*a*, 304*b* receive the left and right receiver rails 206*a*, 206*b*, respectively, to allow the longitudinal movement of the operating group 300 within the interior channel 204 of the receiver 200. The operating group 300 further includes a firing block 306 that is disposed at least partially inside the integrated slide-carrier 302. Alternatively, the firing block 306 may be disposed entirely externally to the integrated slide-carrier. The firing block 306 transmits a force to the firing pin assembly 308, which is at least partially disposed within a bolt 310. The bolt 310 includes notches, grooves, channels, or threads for selectively connecting to another, complementary connector. The operating group 300 further includes a roller 328 that is configured to be movably constrained within a channel of a feed lever 310 (FIG. 4) that is pivotably mounted within the topcover assembly 700.

the receiver 200 may also include a central trunnion 208 into which the barrel assembly 400 connects. The barrel assembly 400 comprises a barrel body 402 that includes a bore 404 therethrough. The bore 404 provides communication between the barrel body 402 and a barrel extension 406. Together, the barrel extension 406 and the bore 404 provide a path through which a bullet (not shown) may exit the firearm 100. The barrel assembly 400 may also include a gas block 408 disposed on the barrel body 402 forward of the barrel extension 406. The gas block 408 covers a gas port 410 and provides fluid communication with a gas block outlet 412. After firing a bullet, rapidly expanding gas may travel the length of the barrel body 402 through the bore 404. As the gas passes the gas port 410, the gas block 408 may channel some of the gas laterally away from the bore 404 and toward the gas block outlet 412. The diverted gas may be expelled through the gas block outlet 412 and provide the motive force to cycle the firearm 100 and prepare for a subsequent firing.

The barrel assembly 400 connects to the receiver 200 by inserting the barrel extension 406 into the central trunnion 208. The barrel extension 406 may connect to the trunnion 208 via threads, a twist lock, a friction fit, a weld, an adhesive or other secure attachment. As noted above, in a preferred aspect, the barrel is a quick-change barrel that a user can easily change in the field. The connection between the barrel 406 and the trunnion 208 may be selectively attachable to facilitate maintenance and repair of the firearm 100. The barrel extension 406 provides complementary notches, grooves, channels, or threads into which the bolt 310 may be received and selectively secured thereto. The connection of the bolt 310 to the barrel extension 406 provides a selectively securable connection between the barrel assembly 400 and the internal operating group 300. The connection of the operating group 300 and the barrel assembly 400 provides a chamber in which a bullet may be held and fired. While not shown in FIG. 4, the barrel assembly and/or the barrel body may include handle or carry handle (e.g., as shown in FIGS. 1, 2, and 5 for example. The carry handle may be foldable or otherwise rotatable to ensure the handle does not interfere with use of the firearm.

The related art firearm 100 further includes a control assembly 500 disposed on the underside of the firearm 100 and selectively connected to the receiver 200. The control assembly includes a housing 502 with front mounting points 504 and rear mounting points 506. The front mounting points 504 may be a notch that is configured to be received into a recession on the receiver body 202, eyelets for a crossbar, a snap fit, or other similar selectively securable connection. Similarly, the rear mounting points 506 may be a notch configured to be received into a recession on the receiver body 202, eyelets for a crossbar, a snap fit, or other similar selectively securable connection. A trigger package 508 is disposed within the housing 502 of the control assembly 500.

Figure 4:
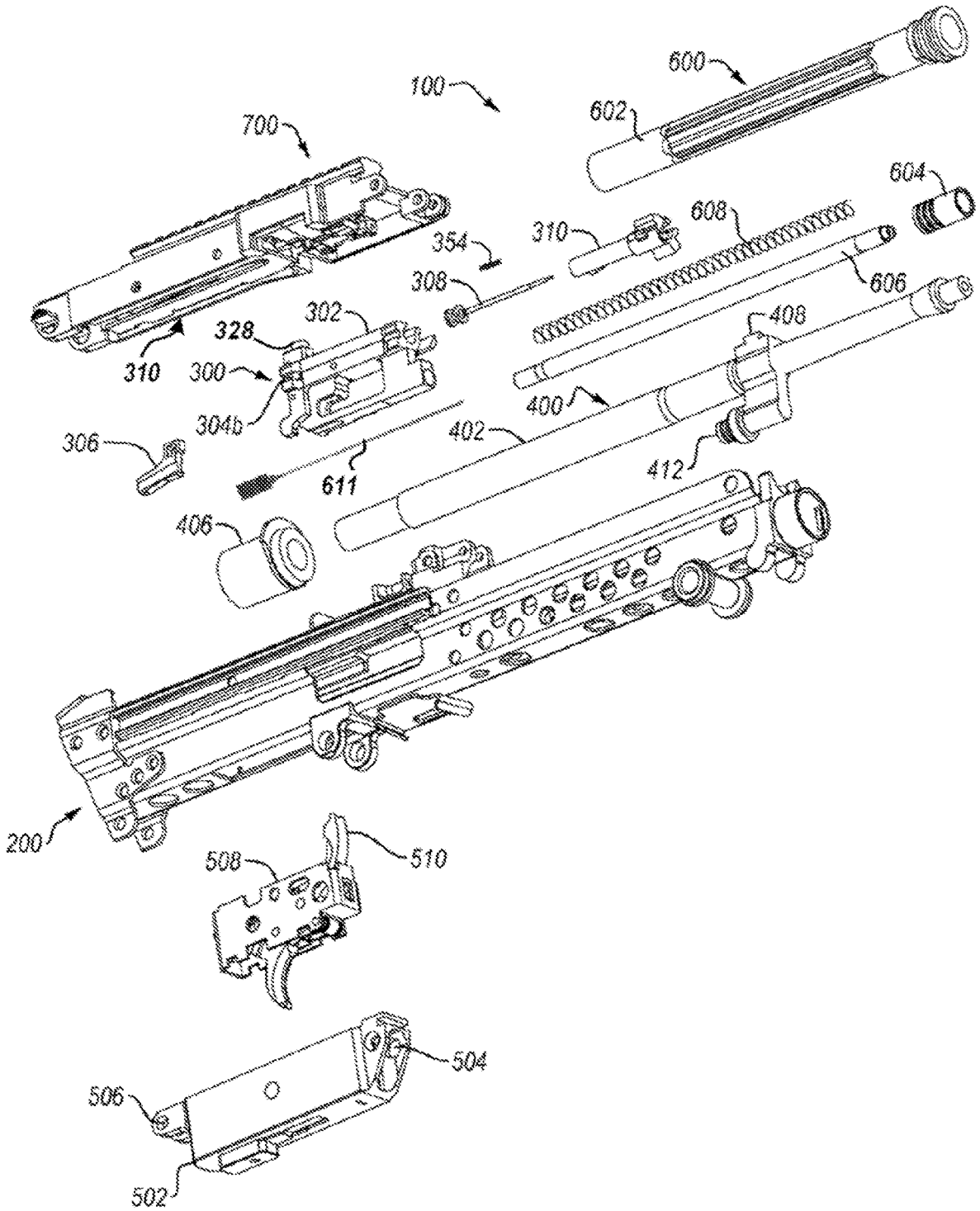
FIG. 4 Related Art
FIG. 4 is a lower isometric exploded view of the example of a firearm of FIG. 3.
Figure 5:
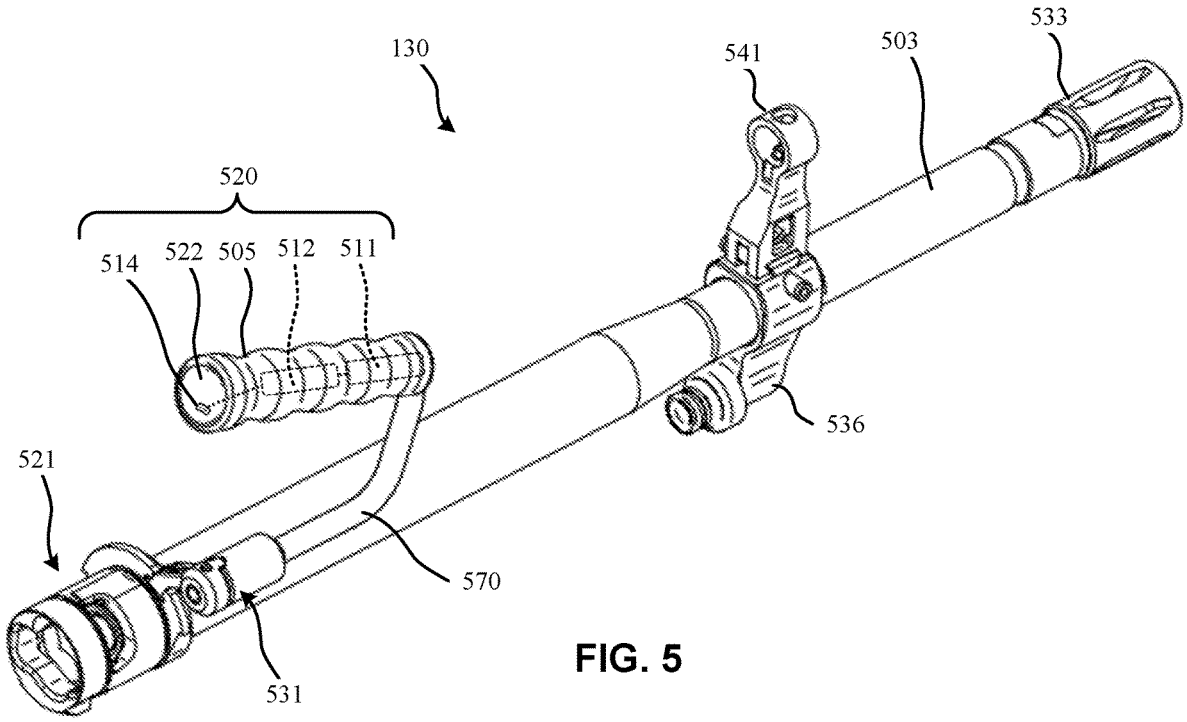
FIG. 5 is a view of a barrel with a shot counter apparatus integrated therein according to aspects of the disclosure.

The trigger package 508 includes an impulse source such as a hammer 510, as depicted in FIGS. 3 and 4, or a striker or other similar linear actuator. The trigger package 508 may be a commercially available trigger package and may include safe, semi-automatic, 2-round burst, 3-round burst, fully automatic, or other fire operation modes selectable with a fire mode selector switch 512. The trigger package 508 may operate the firearm 100 without modification to the trigger mechanism.

The firearm 100 may further comprises a gas piston assembly 600 that provides a fluid and mechanical linkage between the barrel assembly 400 and the operating group 300. The gas piston assembly 600, which may interchangeably be referred to as an OP piston connects the barrel assembly 400 to the operating group 300 by a gas piston-and-cylinder linkage. The gas tube 602 is disposed around, or otherwise forms a fluid seal with, the gas block outlet 412. The gas block outlet 412 may provide a source of high pressure gas, which may impinge upon a surface of a gas piston 604. The gas piston 604 is connected to a rigid operating rod 606, which may hereinafter bet interchangeably referred to as an OP rod, which is, in turn, connected to the operating group 300. The OP rod 606 is connected to the operating rod connection 312 on the integrated slide-carrier 302 of the operating group 300. The connection between the operating rod 606 and the operating rod connection 312, and the connection between the gas piston 604 and the operating rod 606, may be any connection of sufficient strength to communicate the compressive and tensile forces produced during operation of the firearm 100. For example, the connection may be threads, a twist lock, a friction fit, a weld, an adhesive or other secure attachment. Preferably the connection may be a selective connection facilitating maintenance and repair of the firearm 100, and more preferably, the connection may be adjustable to allow precise tuning of the operation of the firearm 100. The operating group may also include a spring guide rod 611 configured to be contained within the spring 608 when the spring is in the OP rod 606 For example, the connection may be a threaded connection providing a selective and adjustable connection. A threaded connection may further comprise a lateral set screw to retain the connection at the selected relative position.

The OP piston assembly 600 may allow the high-pressure gas, the gas contained within the barrel bore 404 and directed through the gas block 408 and gas port 410 to the gas block outlet 412, to provide the energy for a motive force to cycle the operating group 300. The motive force may be a reciprocal linear force resulting from the pressure of the impinging gas from the gas block outlet 412 in the rearward direction, and an opposite linear force from a recoil spring 608 disposed circumferentially around the operating rod.

The firearm 100 may further include a recoil spring 608 that provides a restoring force in opposition to the rearward movement of the gas piston 604. The restoring force causes the gas piston 604 to travel forward in the gas tube 602 until the gas piston 604 returns to a position adjacent the gas block outlet 412. Thus, each firing of the firearm 100 may result in a reciprocal motion of the gas piston 604 within the gas tube 602. The reciprocal motion of the gas piston 604 within the gas tube 602 with each firing of the firearm 100 provides the motive force to reciprocally move the operating group 300 within the receiver 200. The reciprocal motion of the operating group 300 may provide the input force for nearly all other operations of the firearm 100. For example, the motion of the operating group 300 after the firing of a first round and the introduction of high-pressure gas into the gas tube 602, unlocks the bolt 310 from the barrel extension 406, extracts a shell casing, ejects the shell casing, resets the trigger package 508, removes a second round from an ammunition source, inserts the second round into the barrel extension 406, and then locks the bolt 310 in the barrel extension 406.

As can also be seen in FIGS. 3 and 4, the firearm 100 comprises a top cover 700, configured to feed in a belt of ammunition. The top cover 700 feeds ammunition with a lever-activated feed driven by the bearing 328 of the operating group 300. The bearing 328 may follow a track (not shown) in the top cover 700 providing an incremental, lateral feed of ammunition. The top cover 700 is specific to the type and size of ammunition being fired.

FIG. 5 shows one example of a barrel system 130. The barrel system 130 may for example be a quick-change type of barrel with an quick change interface 521. In some cases, the quick-change interface 521 is configured to allow the barrel to be twisted and locked into engagement with a firearm body. Likewise, the quick-change interface 521 may allow a user to quickly disengage and remove the barrel system 130 by twisting the barrel (e.g., via the handle 520) allowing for exchange of the barrel when either the barrel has overheated or has worn-out or otherwise become damage. The handle 520 may be pivotably mounted to barrel assembly 130 via a pivot 531. In some examples, the pivot 531 may include a locking mechanism that contributes to the removal and/or installation of the barrel via the quick-change interface 521. The barrel system 130 may further include a handle connector extension 570, which spaces the handle 520 from a barrel body 503. The spacing between the barrel body 503 and the handle 520 provided by the handle connector extension 570 provides a thermal break and/or spacing between the handle 520 and the barrel body 503 which protect a user's hands either from directly coming into contact with the barrel body 503, which may become very hot (i.e., barrels have been observed to reach temperatures between 500 degrees Fahrenheit (° F.) to 1650° F.). Additionally, the thermal break and/or spacing the handle connector extension 570 provides reduces heat transfer from the barrel body 503 to the handle 520.

The handle 520 may include an outer surface or housing 505. The handle housing 505 may for example be formed of wood, a wood composite, and/or a heat resistant polymer. The handle 520 may further include a counter 512 and/or a battery or power source 511. The counter 512 and/or battery may be in signal communication with a communication and/or charging port 514, which may be external to the handle, flush with a face 522, and/or covered by a port cover (not shown) of the handle 520. In some examples, the communication and/or charging port 514 may be female-style plug configured to have an external interface device connected thereto. In some examples, the communication port 514 may be a standardized port such as a usb-c, usb-a, micro-usb and/or mini-usb port to name a few non-limiting examples. In some examples, the port 514 may be propriety or may include one or more contacts that are configured to connect to a specialized cable. In one example, the port 514 may have a magnet therein or nearby that is configured to magnetically attract and/or locate a connector cable that is configured to provide a communication path between the counter 512 and the external interface device.

In some examples that are either usable with or as an alternative to the aforementioned example with a port 514, the counter 512 include a communication system to send and optionally receive information from a remote device, such as a personal computer (PC), a personal data assistant (PDA), a cell phone, an iPad, or other portable electronic device having communications capabilities. As noted above, in one aspect, the communication may be provided by a cable, which is affixed or plugged into the port 514 of the handle 520, and accessible externally. This connection may be a serial or parallel communications port, using protocols which are available to those skilled in these arts, and may include, but is not limited to, RS-232, or USB and its variants and derivatives. The communication system may also be a one way transmitter having an antenna that broadcasts information, using protocols such as amplitude modulation (AM), frequency modulation (FM), or other means of electronic broadcasting that are known to those skilled in these arts. In a preferred embodiment, the communications is performed via two-way protocols including, but not limited to, those known variously as radio-frequency identification (RFID), IEEE 1901.1 (RuBee), IEEE 802.11 (Wi-Fi), and IEEE 802.15.1-2002 (Bluetooth). Within RFID are two methods, known colloquially as active or passive, regarding whether the message is a modulation of the signal transmitted by an RFID reader, or whether the RFID unit transmits information using its own power, respectively. For low power applications, or applications where a minimal electronic signature is required, a passive RFID approach is desirable. When two way communications are used, the shot counter unit is generally provided a signal or message to initiate the communication protocol.

Various methods are all considered part of the present disclosure and are known to those skilled in these arts. The RFID reader, PC, PDA, or other remote device will perform one or both of requesting data from the counter 512 or providing data to the counter 512. A further aspect of two-way communication is the inclusion of error checking and correcting to provide reliable information from the counter 512. The error checking may include a parity bit, a cyclical redundancy check, Manchester encoding, or other method as is known to those skilled in these arts. The counter 512 may include both two way and one-way communications, such that, for example, the two-way communication is used to configure the counter 512 to temporarily utilize one way communication for purposes such as transmitting engineering data gathered by the shot counter for characterization, analysis, troubleshooting or calibration. As a further option, the counter 512 may include both a wire-connected communications port and a two-way wireless communications system, thereby providing redundancy in the ability to download and upload information from the counter 512.

Figure 6:
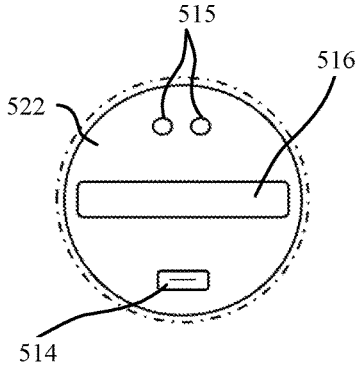
FIG. 6 is a view of a handle/shot counter interface according to aspects of the disclosure.

The counter 512 may also include additional features useful for its intended operation, including, but not limited to: a device for producing sound for an audible enunciator to the weapon user; a light emitting device (e.g., a green and/or red light 515 [FIG. 6] for signifying that a barrel should be changed); for visual annunciation to the weapon user; a screen or display 516 for displaying a shot count or other relevant information, and/or buttons or switches which change the mode of operation, or select certain functions of the unit. The counter unit 512 and associated components (e.g., the battery or power source 511 and communication paths) may be fully enclosed or otherwise packaged within the handle housing 505 and capable of withstanding the environments in which such a weapon is transported and used. For example, the counter 512, battery or power source 511 and/or additional components may be permanently potted within the handle 520. In other examples, a portion of the handle 520 (e.g., face 522) may be removable to allow for access, maintenance and/or refurbishing of the components therein.

One significant advantage of the counter 512 and/or associate components being enclosed within or otherwise associated with the handle 520 is that the components can accurately track a shot count of the barrel system 130 while being isolated from the heat generated in the barrel body 503 during firearm use. This offers an advantage is ensuring the accuracy of the counter 512 and preventing damage to components thereof during use.

In some examples, the counter 512 may be located within or associated with other parts of the barrel system 130. For example, the counter 512 may be located withing or associated with the gas block 536, the front sight 541 and/or the flash hider 533 to name a few examples. In a preferred aspect the counter 512 is mounted to but spaced from direct contact with the barrel body 503 to protect the components therein from heat generated in the barrel body 503 during use of the firearm. While examples are provided above and shown in the Figures, it is noted that the counter 512 may be located at any reasonable location that is mounted to the barrel but yet is far enough from the barrel to avoid damaging heat (generally at least 0.25-1 inch to preferably at least 2-4 inches distance is desired to avoid the high temperatures the barrel can reach in sustained fire). Just like enclosing the counter 512 inside the carry handle creates distance from the heat source and most carry handles are made of material which can further insulate the counter 512, the same principles disclosed herein may be applied to a firearm that lacks a carry handle. In one example, the M3.50 caliber BMG Machine Gun, the counter 512 may be mounted on the barrel shroud found on this weapon. The M3.50 caliber BMG machine gun may be mounted on aircraft due to its higher rate of fire (about twice the typical M2 firing rate of 450-600 rounds per minute or rpm). Due to the high rate of fire, the M3 typically suffers acute barrel wear—thus making the counter 512 and aspects described herein particularly useful for the M3 platform.

In some examples that are either usable with or as an alternative to the examples with a port 514, the counter 512 may transmit either by a one-way or two-way wireless communications mode or link, as described herein, but need only transmit minimal information, namely that a shot was fired. Such a brief transmission signal requires a minimal bandwidth, a minimal message, possibly even as simple as a simple digital pulse on a specified frequency, but generally of sufficient security to prevent a false alarm, delivered to a nearby device capable of delivering the information to a central command. This can be accomplished, as one non-limiting example, by establishing a link between the shot counter unit and a cell phone or PDA carried by the user. The counter 512 may send a message to the cell phone or PDA via any know wireless communication protocol.

Figure 7:
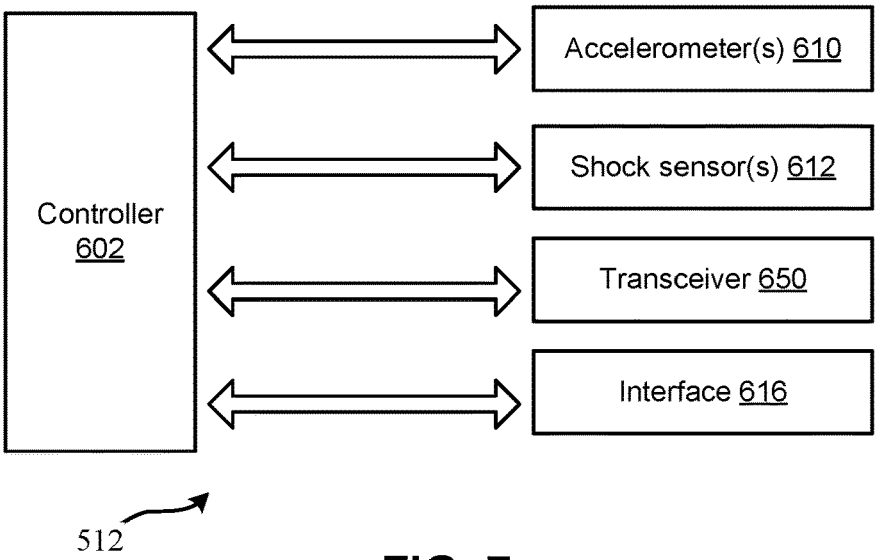
FIG. 7 is a diagram of a control aspect the shot counter apparatus according to aspects of the disclosure.

FIG. 7 is a block-diagram showing example features of the counter 512. The counter may include a controller 602, which may for example be a microcontroller or computer as described below with respect to FIGS. 8 and 9, respectively. The counter 512 may further include one or more accelerometer(s), one or more shock or g-switches/sensor 612, a transceiver 650 and/or an interface. It is noted that while example components are shown in FIG. 7, additional components may be added and/or components may be removed without departing form the scope of the disclosure.

FIG. 1 is a block diagram of the circuit of the module 5 of the present disclosure. The counter 512 may be battery powered by way on non-limiting exemplary illustration. For example, an alkaline one-time use and/or a rechargeable lithium or other rechargeable battery 511 (FIG. 5) may be used to power the counter. The circuitry of module 5 can be mounted on a printed circuit (PC) board which may be potted or embedded within a waterproof and/or heat resistant material. The circuitry of the counter 512 may includes a controller 602. Which may for example be a microcontroller as described below with respect to FIG. 8 programmed to operate the components of counter 512 and/or may be a computer configured to run software to operate counter 512. The counter 512 may include an accelerometer 610, which may for example be a MEMS accelerometer. The counter 512 may additionally include a transceiver 650, which may for example include any known wired or wireless communication device(s). For example, the transceiver 650 may be an RF 2 module or any other preferred serial communications link that can transmit by RS 232 standard, AM or FM transmission through a suitable antenna, Bluetooth, RFID, WiFi, cellular (e.g., 3G, 4G, 5G) or awave to name a few non-limiting examples. The counter 512 may further include an interface 616, which may for example be a graphical user interface and engine (e.g., such as an LCD, LED, OLED, screen or other display and/or lighting indicators to name a few examples.

The wired link, wireless link, and or the graphical interface may provide data associated with and/or display a number of shots fired for the particular barrel, a number of shots left in the life of the barrel (which may be based on an analysis of the number of shots fired and/or the timing between shots) and/or the number of shots fired along with a rating or other numerical system indicative of the abuse that the barrel has been subject to. For example, if a particular barrel is determined to have shot 500 rounds throughout the barrel lifetime, but the shots were fired at a two or more second average between each shot, the estimated lifetime of the barrel may be significantly higher than an identical barrel that shot 500 rounds at full-automatic throughput. The decreased estimated lifespan of second barrel may be shown as a numeric score or other indication. In some examples, the decreased estimated lifespan may be calculated and displayed as an estimated number of shots left before the barrel needs to be exchanged or replaced.

The controller 602 controls the operation of the counter 512. If an accelerometer 610 is employed, the accelerometer may be a plane of firing of the firearm and provides and measures the actual G force of each round fired by the firearm. The controller 602 may then convert the analog output of the accelerometer 610 to a digital recorder. The controller 602 interrogates or periodically samples the accelerometer 610 at its output. If the samples taken by the controller 602 exceed a predetermined threshold, a shot is counted by the controller 602. The controller 602 then continues sampling until the accelerometer output falls below the threshold level at which point the time and profile of the shot is recorded.

Figure 8:
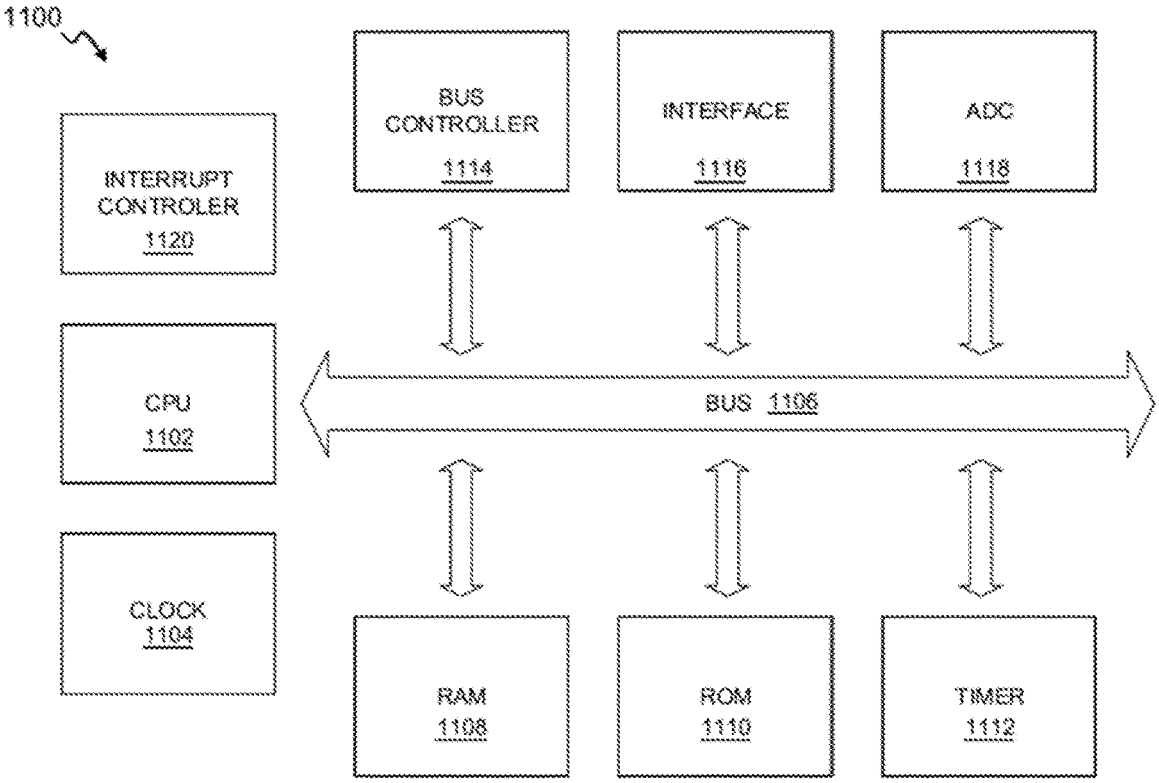
FIG. 8 illustrates an example representative diagram of various components of an example controller usable with aspects of the disclosure.
Figure 9:
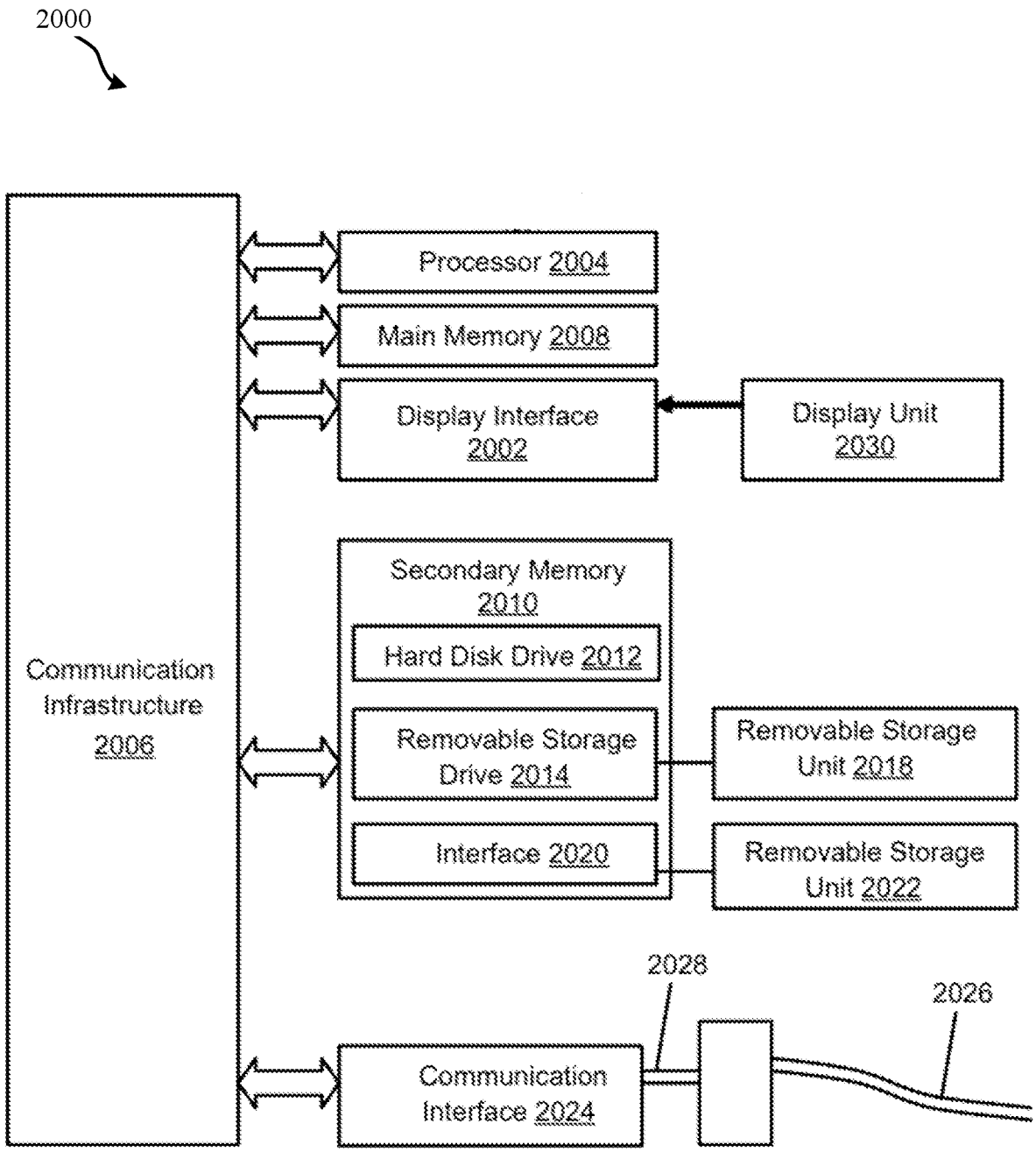
FIG. 9 illustrates an example of a computer system in accordance with aspects of the disclosure.

The data for the shot profile is stored in the memory (e.g., memory described below with respect to FIGS. 8 and 9). It may then store the data internally and/or may be transmitted remotely to a remote location In one example, the accelerometer(s) 610 may be one or more two-axis MEMS accelerometer and are in the plane of firing and it provides and measures the active G force of the shot fired by the barrel. The shot profile information collected will include the recoil and rotation of the barrel due to the shot. The data will continue be collected until the acceleration level falls below the threshold programmed. At this point, the number of shots fired is tallied up and recorded. In addition to recoil sensor data, duration and shots counted, the type of round fired is identified, and the time and profile of the shot fired is recorded and transmitted.

One type of MEMS accelerometer that can be used is ANALOG DEVICES AD22283-B-R2. The microcontroller can be a MSP430F12321DW (SOWB) or an MSP430F12321PW (TSSOP). It is understood that the present disclosure is not limited to any particular sensors or systems and the above are listed as non-limiting illustrative examples. For the most accurate data gathering, the accelerometer used should have good resolution and wide bandwidth. For example, commonly used motion-sensitive accelerometers, such as commercially available crash sensors for motor vehicles, include a low-pass filter having a cut-off frequency of typically 400 Hz or 800 Hz, and response times of 1 millisecond or longer. Shot profile characteristics with frequency content higher than the cut-off frequency are attenuated or diminished. To capture the shot profile as early and as accurately as possible, the accelerometer should be fast-acting, that is, it should have a high bandwidth. As one non-limiting example, the ADXL001 accelerometer from Analog Devices, Inc. (Norwood, Mass.) has a bandwidth of 22,000 Hz. When such a fast-acting accelerometer is used, response times can be as brief as 0.05 milliseconds.

In some examples, the counter 512 may further include one or more shock sensor(s) or G-sensor(s) or switch(s) 612 (shock sensor, G-sensor, or G-switch may be used interchangeably throughout the disclosure). In a preferred aspect the G-switch may allow allows power conservation through two or more modes of operation, namely "normal" operation, and a "sleep" mode, which draws a greatly reduced amount of current from the battery. To achieve a long battery life, the counter 512 is ideally in the sleep mode except when a shot is being fired by the weapon, and except when the shot counter is communicating with an external or a remote device, as will be described below. When the shot is complete, the counter 512 returns to the sleep mode, however it may remain in the normal mode for a sufficiently long duration to capture a subsequent shot, as for example when a self-loading submachine gun is firing shots in rapid succession. The signal to switch the counter 512 from sleep to normal mode is performed with a sub circuit within the shot counter called the wake-up circuit. In a preferred embodiment the wake-up circuit consists of a normally closed G-switch, which is an electromechanical device in which an electrical contact opens when the g-switch experiences an acceleration greater than a pre-determined threshold. It is the experience of the inventors that a normally closed g-switch activates much more rapidly than a normally open g-switch, so the use of a normally closed g-switch provides an advantage of waking up the counter 512 closer in time to the start of a bullet being fired. As a non-limiting illustrative example, the normally closed g-switch may be set at 7 gs (one g is equivalent to earth's gravitational acceleration, or about 9.8 meters per second per second). This wake-up circuit, consisting primarily, but not necessarily exclusively of the g-switch, is connected to a digital input of the counter 512 such that when the g-switch changes to an electrically open (no contact) state, the counter 512 will switch from sleep mode to normal mode. In this example, when the recoil of a bullet being fired causes the weapon to experience an acceleration greater than 7 gs, the counter 512 is "woken up" from sleep mode.

Additional methods and description for tracking or otherwise analyzing data of shots fired, which may be applicable to the analysis of shots fired thought the barrel as disclosed herein are described in U.S. Pat. No. 8,826,575 to Ufer et al., entitled: "Self Calibrating Weapon Shot Counter," U.S. Pat. No. 8,109,023 to Pikielny, entitled: "Shot Counter," and U.S. Pat. No. 7,143,644 to Johnson et al., entitled "Device for Collecting Statistical Data for Maintenance of Small-Arms." The entirety of the three listed patents above are expressly incorporated herein by reference.

In some implementations, as part of or incorporating various features and methods described herein, one or more microcontrollers may be implemented (e.g., as the controller 602 described above with respect to FIG. 7) for carrying out various operations in accordance with aspects of the present invention. Various components of such a controller 1100 are shown in representative block diagram form in FIG. 11. In FIG. 11, the controller 1100 includes a CPU 1102, clock 1104, RAM 1108, ROM 1110, a timer 1112, a BUS controller 1114, an interface 1116, and an analog-to-digital converter (ADC) 1118 interconnected via a BUS 1106.

The CPU 1102 may be implemented as one or more single core or multi-core processors, and receive signals from an interrupt controller 1120 and a clock 1104. The clock 1104 may set the operating frequency of the entire microcontroller 1100 and may include one or more crystal oscillators having predetermined frequencies. Alternatively, the clock 1104 may receive an external clock signal. The interrupt controller 1120 may also send interrupt signals to the CPU, to suspend CPU operations. The interrupt controller 1120 may transmit an interrupt signal to the CPU when an event requires immediate CPU attention.

The RAM 1108 may include one or more Static Random Access Memory (SRAM), Dynamic Random Access Memory (DRAM), Synchronous Dynamic Random Access Memory (SDRAM), Double Data-Rate Random Access Memory (DDR SDRAM), or other suitable volatile memory. The Read-only Memory (ROM) 1110 may include one or more Programmable Read-only Memory (PROM), Erasable Programmable Read-only Memory (EPROM), Electronically Erasable Programmable Read-only memory (EEPROM), flash memory, or other types of non-volatile memory.

The timer 1112 may keep time and/or calculate the amount of time between events occurring within the controller 1100, count the number of events, and/or generate baud rate for communication transfer. The BUS controller 1114 may prioritize BUS usage within the controller 1100. The ADC 1118 may allow the controller 1100 to send out pulses to signal other devices.

The interface 1116 may comprise an input/output device that allows the controller 1100 to exchange information with other devices. In some implementations, the interface 1116 may include one or more of a parallel port, a serial port, or other computer interfaces.

In addition, aspects of the present disclosures may be implemented using hardware, software, or a combination thereof and may be implemented in one or more computer systems or other processing systems. In an aspect of the present disclosures, features are directed toward one or more computer systems capable of carrying out the functionality described herein. An example of such the computer system 2000 is shown in FIG. 9.

The computer system 2000 may include one or more processors, such as processor 2004. The processor 2004 may be connected to a communication infrastructure 2006 (e.g., a communications bus, cross-over bar, or network). Various software aspects are described in terms of this example computer system. After reading this description, it will become apparent to a person skilled in the relevant art(s) how to implement aspects of the disclosures using other computer systems and/or architectures.

The computer system 2000 may include a display interface 2002 that forwards graphics, text, and other data from the communication infrastructure 2006 (or from a frame buffer not shown) for display on a display unit 2030, which may be analogous with the display interface 102. Computer system 2000 also includes a main memory 2008, preferably random access memory (RAM), and may also include a secondary memory 2010. The secondary memory 2010 may include, for example, a hard disk drive 2012, and/or a removable storage drive 2014, representing a floppy disk drive, a magnetic tape drive, an optical disk drive, a universal serial bus (USB) flash drive, etc. The removable storage drive 2014 reads from and/or writes to a removable storage unit 2018 in a well-known manner. Removable storage unit 2018 represents a floppy disk, magnetic tape, optical disk, USB flash drive etc., which is read by and written to removable storage drive 2014. As will be appreciated, the removable storage unit 2018 includes a computer usable storage medium having stored therein computer software and/or data.

Alternative aspects of the present disclosure may include secondary memory 2010 and may include other similar devices for allowing computer programs or other instructions to be loaded into computer system 2000. Such devices may include, for example, a removable storage unit 2022 and an interface 2020. Examples of such may include a program cartridge and cartridge interface (such as that found in video game devices), a removable memory chip (such as an erasable programmable read only memory (EPROM), or programmable read only memory (PROM)) and associated socket, and other removable storage units 2022 and interfaces 2020, which allow software and data to be transferred from the removable storage unit 2022 to computer system 2000.

Computer system 2000 may also include a communications interface 2024. Communications interface 2024 allows software and data to be transferred between computer system 2000 and external devices. Examples of communications interface 2024 may include a modem, a network interface (such as an Ethernet card), a communications port, a Personal Computer Memory Card International Association (PCMCIA) slot and card, etc. Software and data transferred via communications interface 2024 are in the form of signals 2028, which may be electronic, electromagnetic, optical or other signals capable of being received by communications interface 2024. These signals 2028 are provided to communications interface 2024 via a communications path (e.g., channel) 2026. This path 2026 carries signals 2028 and may be implemented using wire or cable, fiber optics, a telephone line, a cellular link, an RF link and/or other communications channels. In this document, the terms "computer program medium" and "computer usable medium" are used to refer generally to media such as a removable storage drive 2018, a hard disk installed in hard disk drive 2012, and signals 2028. These computer program products provide software to the computer system 2000. Aspects of the present disclosures are directed to such computer program products.

Computer programs (also referred to as computer control logic) are stored in main memory 2008 and/or secondary memory 2010. Computer programs may also be received via communications interface 2024. Such computer programs, when executed, enable the computer system 2000 to perform the features in accordance with aspects of the present disclosures, as discussed herein. In particular, the computer programs, when executed, enable the processor 2004 to perform the features in accordance with aspects of the present disclosures. Accordingly, such computer programs represent controllers of the computer system 2000.

In an aspect of the present disclosures where the method is implemented using software, the software may be stored in a computer program product and loaded into computer system 2000 using removable storage drive 2014, hard drive 2012, or communications interface 2020. The control logic (software), when executed by the processor 2004, causes the processor 2004 to perform the functions described herein. In another aspect of the present disclosures, the system is implemented primarily in hardware using, for example, hardware components, such as application specific integrated circuits (ASICs). Implementation of the hardware state machine so as to perform the functions described herein will be apparent to persons skilled in the relevant art(s).

Figure 10:
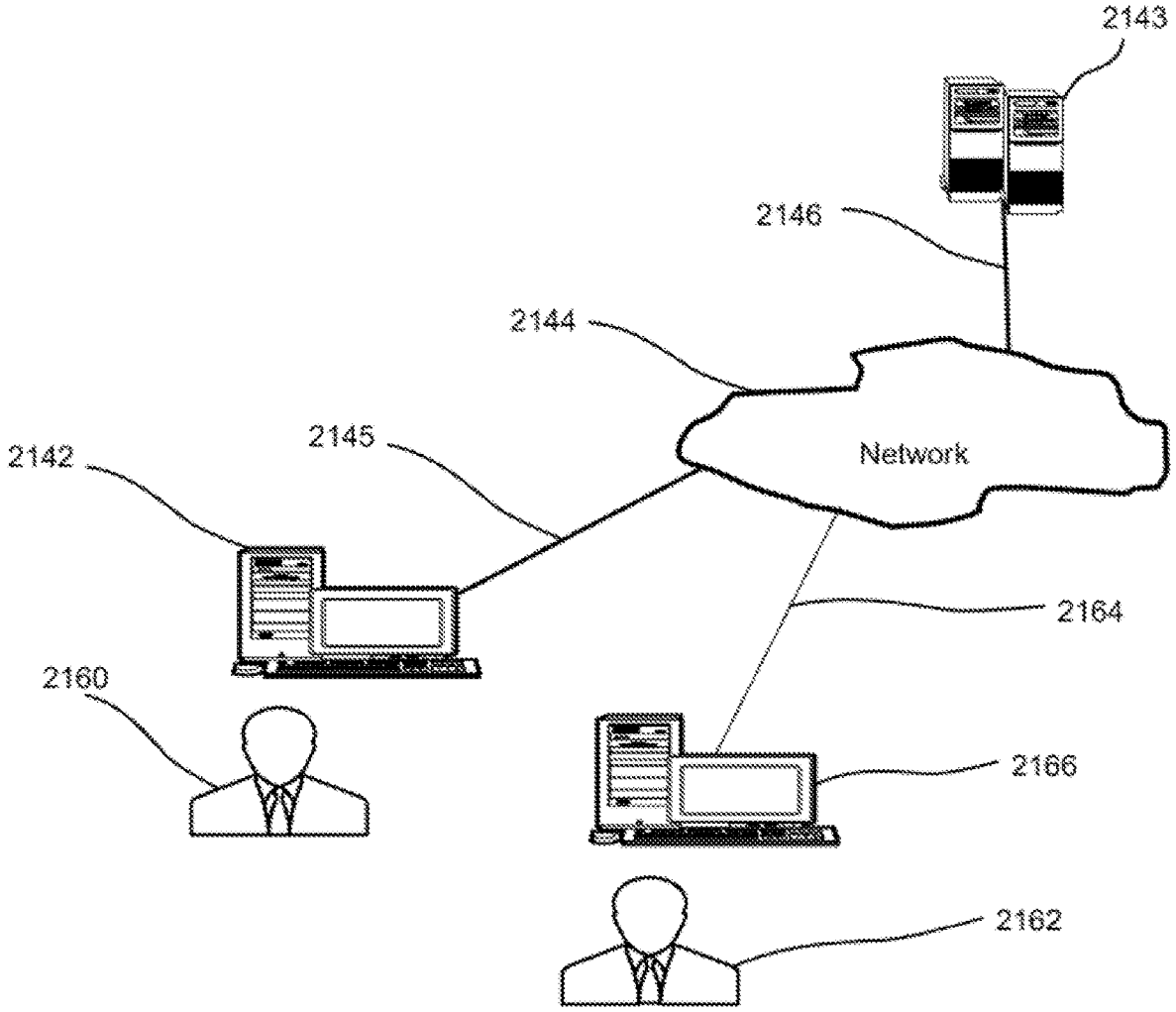
FIG. 10 illustrates an example of various system components in accordance with aspects of the present disclosure.

FIG. 10 is a block diagram of various example communication system components usable in accordance with an aspect of the present disclosure. The communication system 2100 includes one or more accessors 2160, 2162 (which may for example comprise any of the aforementioned systems and features) and one or more terminals 2142, 2166. In one aspect, data for use in accordance with aspects of the present disclosure is, for example, input and/or accessed by accessors 2160, 2162 via terminals 2142, 2166, such as personal computers (PCs), minicomputers, mainframe computers, microcomputers, telephonic devices, or wireless devices, such as personal digital assistants ("PDAs") or a hand-held wireless devices coupled to a server 2143, such as a PC, minicomputer, mainframe computer, microcomputer, or other device having a processor and a repository for data and/or connection to a repository for data, via, for example, a network 2144, such as the Internet or an intranet, and couplings 2145, 2146, 2164. The couplings 2145, 2146, 2164 include, for example, wired, wireless, or fiberoptic links. In another example variation, the method and system in accordance with aspects of the present disclosure operate in a stand-alone environment, such as on a single terminal.

While a number of example aspects and aspects have been discussed above, those of skill in the art will recognize that still further modifications, permutations, additions and sub-combinations thereof of the features of the disclosed aspects are still possible. It is therefore intended that the following appended claims and claims hereafter introduced are interpreted to include all such modifications, permutations, additions and sub-combinations as are within their true spirit and scope.

This written description uses examples to disclose aspects of the invention, including the preferred embodiments, and also to enable any person skilled in the art to practice the aspects thereof, including making and using any devices or systems and performing any incorporated methods. The patentable scope of these aspects is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Aspects from the various embodiments described, as well as other known equivalents for each such aspect, can be mixed and matched by one of ordinary skill in the art to construct additional embodiments and techniques in accordance with principles of this application.

What is claimed is:

1. An automatic firearm comprising:

a firearm frame, the firearm frame comprising a firearm frame shot counter to track a number of shots or rounds fired with the firearm frame;

a barrel that is removeably mounted to the firearm frame, wherein the barrel further comprises a handle mounted thereon, the barrel further comprises:

a barrel shot counter, wherein the barrel shot counter is configured to track a number of shots or rounds fired through the barrel, wherein the barrel shot counter is configured to provide an estimation of a remaining lifespan of the barrel.

2. The automatic firearm of claim 1, wherein the barrel shot counter further tracks a time between each shot fired through the barrel.

3. The automatic firearm of claim 2, wherein the barrel shot counter is configured to communicate the number of shots fired through the barrel and the time between each shot fired to an external device via a wired or wireless link.

4. The automatic firearm of claim 1, wherein the handle further comprises a battery for providing power to the barrel shot counter.

5. The automatic firearm of claim 1, wherein the barrel shot counter comprises:

a microcontroller with a non-volatile memory for analyzing and storing sensor data; and an accelerometer for detecting shots fired through the barrel.

6. The automatic firearm of claim 5, wherein the barrel shot counter further comprises:

a shock sensor, wherein the shock sensor activates a power circuit to the microcontroller for waking the microcontroller from a low power or no power mode.

7. The automatic firearm of claim 5, wherein the handle further comprises a communication port, wherein the communication port is configured to have an external device connected thereto for downloading at least one of the number of shots fired through the barrel or a time between each shot fired.

8. A barrel usable with an automatic firearm with a frame mounted shot counter comprising:

a quick a quick-change interface for removal and exchange of the barrel from a frame of the automatic firearm; and a barrel shot counter mounted to but spaced from an outer surface of the barrel, wherein the barrel shot counter is configured to track a number of shots fired through the barrel, wherein the barrel shot counter is configured to provide an indication of a remaining lifespan of the barrel.

9. The barrel of claim 8, further comprising a handle mounted thereto, wherein the barrel shot counter is mounted to or is located within the handle.

10. The barrel of claim 8, wherein the barrel shot counter is mounted 0.25-4 inches from the surface of the barrel.

11. The barrel of claim 8, wherein the barrel shot counter is mounted to at least one of a barrel gas block, a barrel front sight, a barrel flash hider, or a barrel shroud.

12. The barrel of claim 8, wherein the barrel shot counter further tracks a time between each shot fired through the barrel.

13. The barrel of claim 12, wherein the barrel shot counter is configured to communicate the number of shots fired through the barrel and the time between each shot fired to an external device via a wired or wireless link.

14. The barrel of claim 9, wherein the handle further comprises a battery for providing power to the barrel shot counter.

15. The barrel of claim 8, wherein the barrel shot counter comprises:

a microcontroller with a non-volatile memory for analyzing and storing sensor data; and an accelerometer for detecting shots fired through the barrel.

16. The barrel of claim 15, wherein the barrel shot counter further comprises:

a shock sensor, wherein the shock sensor activates a power circuit to the microcontroller for waking the microcontroller from a low power or no power mode.

17. The barrel of claim 9, wherein the handle further comprises a communication port, wherein the communication port is configured to have an external device connected thereto for downloading at least one of the number of shots fired through the barrel or a time between each shot fired.

18. A shot counter system for an automatic firearm comprising:

a firearm frame shot counter for detecting shots fired with a frame of the automatic firearm;

a barrel shot counter configured to be mounted to a barrel of the automatic firearm, the barrel shot counter comprising:

a microcontroller with a non-volatile memory for analyzing and storing sensor data; and an accelerometer for detecting shots fired through the barrel, wherein the barrel shot counter is configured to track a number of shots fired through the barrel, wherein the barrel shot counter is configured to provide an estimation of a remaining lifespan of the barrel.

19. The shot counter system of claim 18, wherein the barrel shot counter is mounted within a barrel-handle of the barrel.

20. The automatic firearm of claim 1, wherein the firearm frame is a receiver with a firearm grip.

* * * * *